US006533630B1

(12) United States Patent
Terajima et al.

(10) Patent No.: US 6,533,630 B1
(45) Date of Patent: Mar. 18, 2003

(54) VACUUM DEVICE AND METHOD OF MANUFACTURING PLASMA DISPLAY DEVICE

(75) Inventors: Ryuuichi Terajima, Kanagawa (JP); Yukio Masuda, Kanagawa (JP); Toshiharu Kurauchi, Ibaraki (JP); Ken Momono, Chiba (JP); Yoshio Sunaga, Kanagawa (JP); Hidenori Suwa, Kanagawa (JP); Kyuzo Nakamura, Kanagawa (JP)

(73) Assignee: Nihon Shinku Gijutsu Kabushiki Kaisha, Kanagawa (JP)

( * ) Notice: Subject to any disclaimer, the term of this patent is extended or adjusted under 35 U.S.C. 154(b) by 0 days.

(21) Appl. No.: 09/579,274

(22) Filed: May 26, 2000

(51) Int. Cl.[7] ..... H01J 9/26

(52) U.S. Cl. ..... 445/24; 445/58; 445/66; 445/25

(58) Field of Search ..... 445/24, 25, 58, 445/66

(56) References Cited

U.S. PATENT DOCUMENTS 4,799,911 A * 1/1989 Relder ..... 445/14
4,799,912 A * 1/1989 Salgo ..... 445/26
6,049,167 A * 4/2000 Onitsuka et al. ..... 313/512
6,338,663 B1 * 1/2002 Watkins et al. ..... 445/60

FOREIGN PATENT DOCUMENTS

| | | |
|---|---|---|
| JP | 52-111371 | 9/1977 |
| JP | 4-264328 | 9/1992 |
| WO | WO98/39789 | 9/1998 |

* cited by examiner

*Primary Examiner*—Kenneth J. Ramsey
(74) *Attorney, Agent, or Firm*—Armstrong, Westerman & Hattori, LLP.

(57) ABSTRACT

A vacuum display device for enabling the manufacture of high quality plasma display device with high throughput. A front panel 6 constituting a plasma display device is carried into a film deposition chamber 22; and a MgO thin film is deposited in a vacuum atmosphere. The front panel 6 is then carried into an alignment chamber 11 without being exposed to the atmosphere and aligned with a rear panel 7 that has been subjected to degassing in a vacuum atmosphere. There is no absorption of gas, such as moisture; and the quality of the thin film is not degraded. After alignment, aging processing is carried out without exposure to the atmosphere, followed by gas encapsulation and hermetic sealing, which further increases throughput.

12 Claims, 8 Drawing Sheets

VACUUM DEVICE AND METHOD OF MANUFACTURING PLASMA DISPLAY DEVICE

BACKGROUND OF THE INVENTION

1. Technical Field

The present invention relates to a vacuum device for manufacturing a plasma display device, and more particularly to a vacuum device enabling high throughput.

2. Related Art

Plasma display devices that can form a large screen with thin structure have been attracting widespread attention in recent years. Reference numeral 101 in FIG. 9 represents' the structure of an AC type plasma display device, and comprises a front panel 120 and a rear panel 130.

Electrodes 121 and 131 are respectively provided on the surfaces of the front panel 120 and the rear panel 130. The front panel 120 and the rear panel 130 have the electrodes 121 and 131 facing each other. Each of the electrodes 121 on the front panel 120 and the electrodes 131 on the rear panel 130 are formed slender shapes respectively. The electrodes 121 are arranged parallel with each other, and the electrodes 131 are arranged parallel with each other. The front panel 120 and the rear panel 130 are arranged parallel with each other. The electrodes 121 on the front panel 120 and the electrodes 131 on the rear panel 130 are arranged perpendicular to each other. The AC type plasma display device is comprised enable to selecting and applying voltages to appropriate electrodes among the plurality of electrodes 121 and 131 desired positions on the plasma display device 101 can be made to emit light.

The manufacturing process of the front panel 120 of the plasma display device 101 will now be described with reference to FIG. 8. First of all, a transparent glass substrate 141 is prepared (FIG. 8(*a*)). A transparent conductive film (for example, ITO film) 142 is then formed on this glass substrate 141 (FIG. 8(*b*)), and then a metallic thin-film 143 is formed (FIG. 8(*c*)).

The transparent conductive film 142 and the metallic thin film 143 are then subjected to patterning, and after an electrode 121 comprising a transparent electrode 144 and a supplementary electrode 145 has been formed (FIG. 8(*d*)), a transparent dielectric layer (for example, a low melting point glass layer) 146 is formed on the surface of this electrode 121 (FIG. 8(*e*)).

Finally, the glass substrate 14 is taken into a vacuum chamber where a protective film 147 of MgO is deposited on the surface of the transparent dielectric film 146 by vapor deposition (FIG. 8(*f*)), and the glass substrate 141 is ejected from the vacuum chamber and relatively positioned opposite to and parallel with a separately formed rear panel 130.

Next, the front panel 120 and the rear panel 130 are sealed, and any atmospheric gas remaining between the panel 120 and the panel 130 is evacuated so as to form a vacuum between the panel 120 and the panel 130. During this evacuation, the panel is degassed by heating and after that a voltage is applied to the panel to cause electric discharge and aging processing is carried out.

Next, electric discharge gas is introduced between the panel 120 and the panel 130, which are completely hermetically sealed to form the plasma display device, and performance testing is carried out.

However, with the manufacturing process as described above, the protective film 147 is temporarily exposed to the atmosphere which means that it is subjected to the effects of moisture and there is a problem of deterioration (MgO is altered to $Mg(OH)_2$). Also, after hermetic sealing, since degassing and aging processing is carried out, evacuation must be carried out through small holes existing between the panel 120 and the panel 130. Consequently, it is necessary to prolong the time for which degassing by heating introduced and aging process is carried out, which lowers throughput.

SUMMARY OF THE INVENTION

The present invention solves the above described problems, and an object of the invention is to provide a vacuum apparatus that can manufacture a high quality plasma display panel.

In order to achieve the above described object, the present invention provides a vacuum device for manufacturing a plasma display device having a front panel and a rear panel, comprising a film deposition chamber for depositing a thin film on a surface of the front panel in a vacuum atmosphere, and an alignment chamber for relatively aligning the front panel and the rear panel in the vacuum atmosphere, wherein the front panel is conveyed between the film deposition chamber and the alignment chamber without being exposed to the atmosphere.

In another aspect of the present invention, the rear panel can be conveyed into the alignment chamber without passing through the film deposition chamber.

In a further aspect of the invention, when the rear panel is conveyed the alignment chamber maintains a vacuum atmosphere.

With the present invention, it is possible to also have a structure where an assembly line having a hermetic sealing chamber is connected to the alignment chamber, the relatively aligned front panel and the rear panel are conveyed from the alignment chamber into the hermetic sealing chamber without being exposed to the atmosphere, and gas is introduced between the relatively aligned front panel and the rear panel, to enable sealing.

It is also possible to have a structure where an aging chamber having a heating device located therein is provided in the assembly line, the relatively aligned front panel and rear panel are conveyed into the aging chamber before being sealed, the heating device is caused to generate heat while the inside of the aging chamber is being evacuated, and the front panel and the rear panel are heated in the state of being relatively aligned.

In another aspect of the present invention, it is possible to have a structure where an aging chamber having a power supply is provided in the assembly line, the relatively aligned front panel and rear panel are conveyed into the aging chamber before being sealed, electric discharge gas is introduced into the aging chamber while it is being evacuated, a voltage is applied to electrodes on the front panel and the rear panel by the power supply, and electric discharge is caused between the front panel and the rear panel.

In yet a further aspect of the present invention, it is possible to have a structure where an examination chamber having a power supply is provided between the aging chamber and the sealing chamber, the front panel and the rear panel having completed processing in the aging chamber are conveyed to the examination chamber before sealing, a voltage is applied by the power supply to electrode on the front panel and the rear panel while evacuating the examination room, and electric discharge is caused between the front panel and the rear panel.

The present invention also provides a method of manufacturing a plasma display device comprising the steps of conveying a front panel into a film deposition chamber, depositing a thin film in a vacuum atmosphere and then conveying the front panel to an alignment chamber without exposing the front panel to the atmosphere, relatively aligning the front panel and a separately conveyed rear panel inside the alignment panel and sealing the front panel and the rear panel with an electric discharge gas introduced between the front panel and the rear panel.

With the above described structure, the present invention conveys affront panel constituting a plasma display device into a film deposition chamber, and after depositing a thin film in a vacuum atmosphere it is conveyed to an alignment chamber without being exposed to the atmosphere and is aligned with a rear panel in a vacuum atmosphere. Accordingly, gaseous elements such as moisture etc. are not adsorbed into the thin film deposited in the film deposition chamber and the quality of the thin film is not degraded.

The rear panel can also be conveyed to the alignment chamber after degassing processing. In this case, the degassing time for the rear panel is longer than the time required for thin film deposition on the front panel, which means that if a plurality of rear panels are continuously subjected to degassing throughput will not be reduced.

After the front panel and the rear panel have been aligned, heating is applied in the aligned state without exposure to the atmosphere, and charging gas and sealing (hermetic sealing processing) is carried out following degassing of the surface or the front panel the surface of the rear panel arranged opposite to each other, which reduces the processing time. Performing degassing processing before sealing in this way is known as aging processing.

As well as performing aging processing by heating, it is also possible to perform aging processing by introducing electric discharge gas such as a noble gas between the front panel and the rear panel located in a vacuum atmosphere in an aligned state, applying a voltage to electrodes of the front panel and the rear panel, generating a plasma by electric discharge between the front panel and the rear panel, and carrying out aging processing by degassing due to the plasma.

It is also possible to perform aging processing using plasma after aging processing using heating.

Before carrying out the hermetic sealing, if a voltage is applied to electrodes of the front panel and the rear panel to cause light emission and examination carried out in the light emitting state, defective products can be identified without performing the sealing process.

According to the present invention as mentioned above, the front panel and rear panel are processed concurrently in a vacuum atmosphere for manufacturing plasma display device.

DESCRIPTION OF PREFERRED EMBODIMENTS

Figure 1:
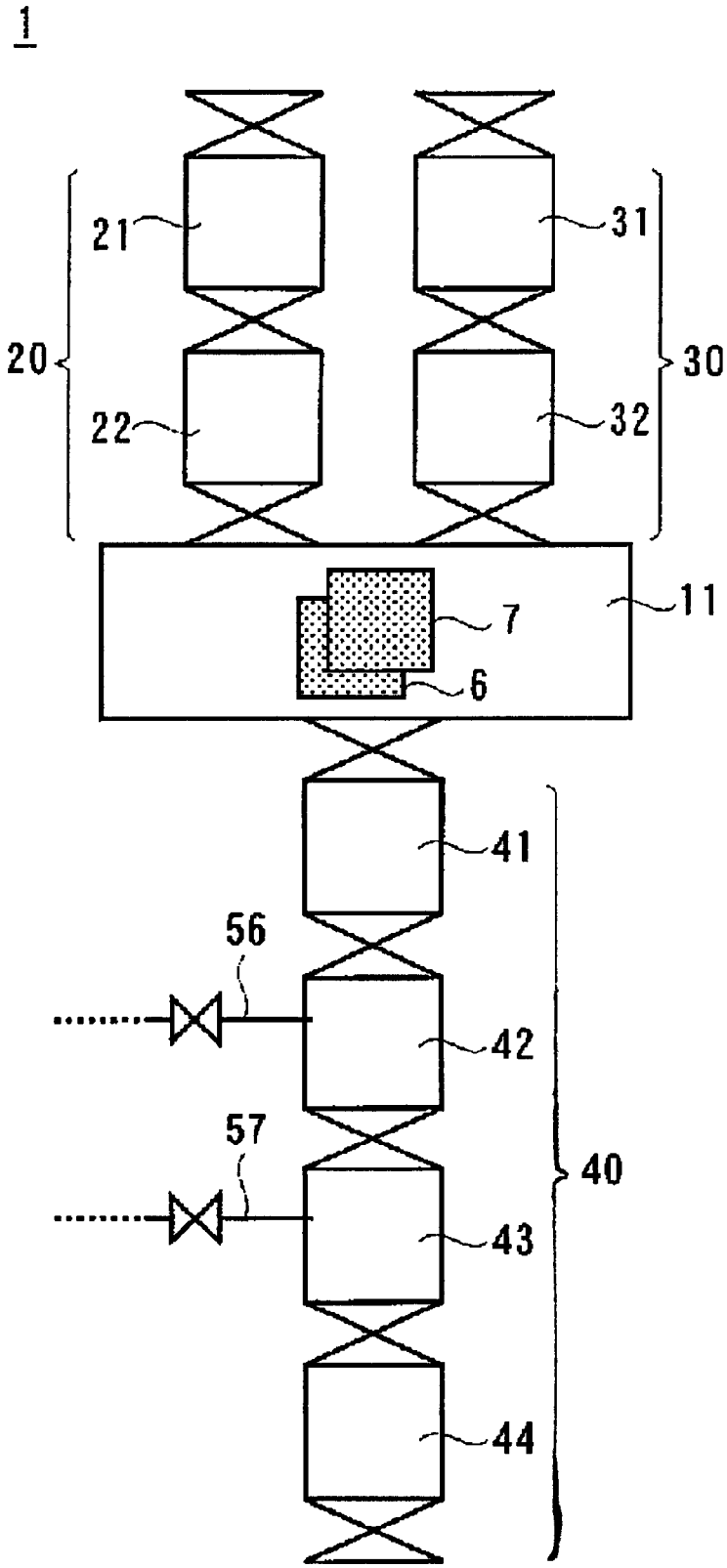
FIG. 1 shows a first example of a vacuum device of the present invention.

Embodiments of the present invention will now be described in detail with reference to the attached drawings. In FIG. 1, reference numeral 1 represents a vacuum device of an example of the present invention. This vacuum device 1 comprises a front panel side production line 20, a rear panel side production line 30, an alignment chamber 11 and an assembly line 40.

The front panel side production line 20 and the rear panel side production line 30 are stages prior to the alignment chamber 11 in the manufacturing process for a plasma display, and are connected to an entrance side of the alignment chamber 11. The assembly line 40 is a stage after the alignment chamber 11 and is connected to an exit side of the alignment chamber 11. Inside of those chambers of the vacuum device 1 is in vacuum atmosphere previously.

The front panel side production line 20 has a carry-in chamber 21 and a film deposition chamber 22 located between the carry-in chamber 21 and the alignment chamber 11. Similarly, the rear panel side production line 30 has a carry-in chamber 31 and a degassing chamber 32 located between the carry-in chamber 31 and the alignment chamber 11.

Figure 8:
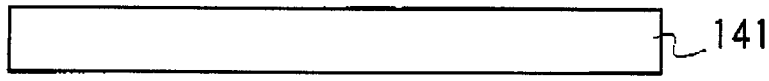
FIG. 8(*a*) to FIG. 8(*f*) are drawings illustrating the method of manufacturing a front panel.
Figure 8:
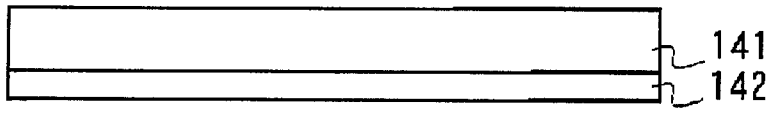
Figure 8:
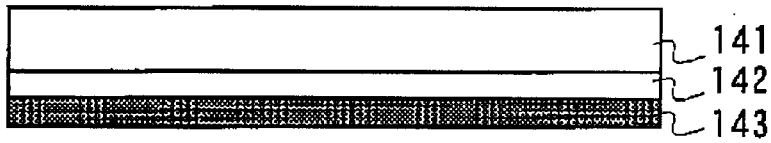
Figure 8:
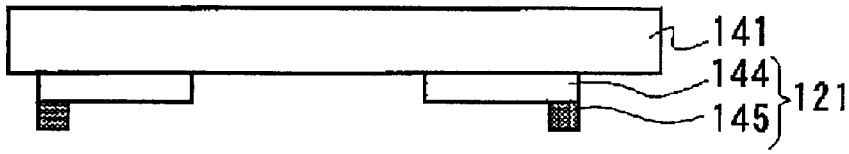
Figure 8:
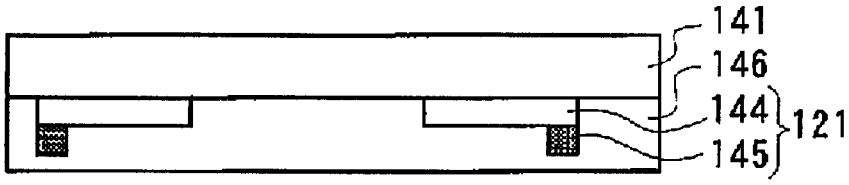
Figure 8:
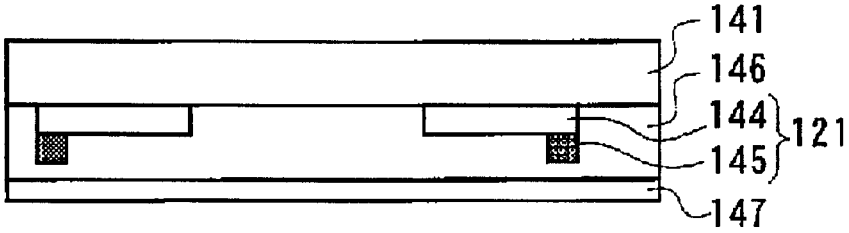
Figure 9:
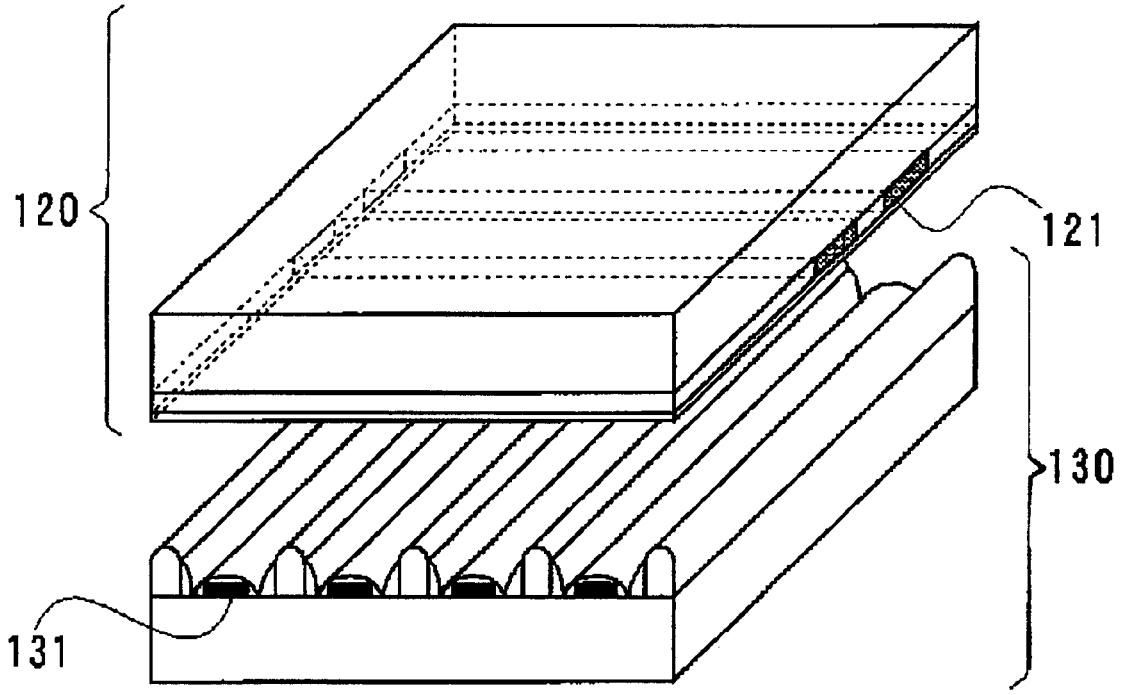
FIG. 9 is a drawing illustrating a plasma display panel.

First of all, the manufacturing processes used by the front panel, side production line 20 will be described. The carry-in chamber 21 is exposed to the atmosphere and a front panel, on which a transparent dielectric layer 146 as shown in FIG. 8(*e*) without protect film 147 is formed, is carried into the carry-in chamber 21.

After the inside of the carry-in chamber 21 has been evacuated, the inside of the carry-in chamber 21 is connected to the film deposition chamber 22 and the front panel is carried into the film deposition chamber 22.

Figure 3:
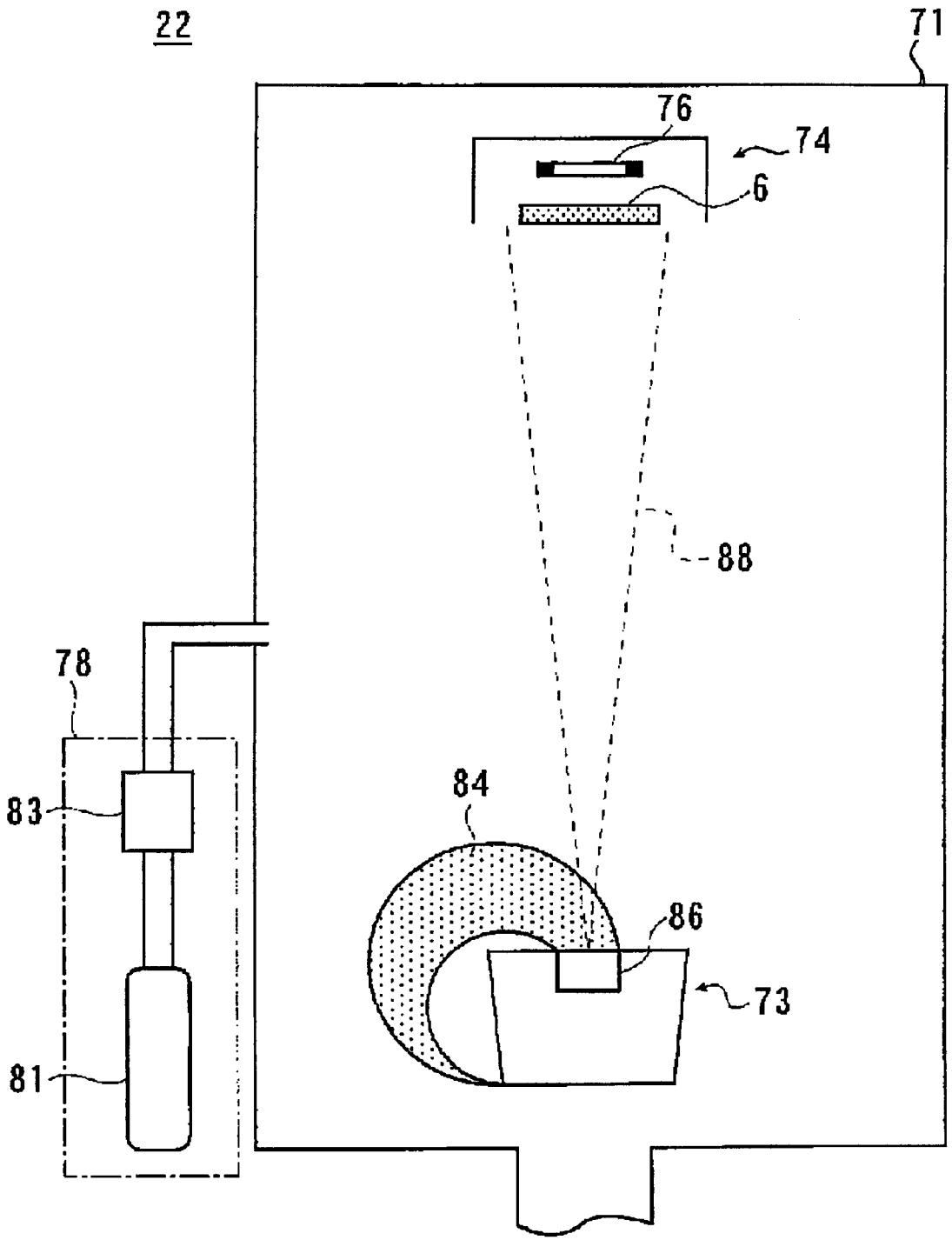
FIG. 3 shows an example of an MgO film in deposition device capable of being used with the present invention.

An example of the structure of the film deposition chamber 22 is shown in FIG. 3. This film deposition chamber 22 has a vacuum chamber 71, with an evaporation source 73 arranged on a bottom wall of the vacuum chamber 71 and a panel holder 74 arranged towards the ceiling. A gas introduction system 78 are arranged outside the vacuum chamber 71. The gas introduction system has a gas cylinder 81 and amass flow controller 83 connected in this order, and is constructed so that oxygen gas held inside the gas cylinder 81 can be introduced to the inside of the vacuum chamber 71 while controlling the flow rate using the mass flow controller 83.

A vapor deposition material 86 deposited of MgO is arranged inside the evaporation source 73, and after the inside of the vacuum chamber 71 into which oxygen gas introduced has been stabilized at a specified pressure, an electron beam 84 is irradiated to the vapor deposition material 86 causing emission of vapor the vapor deposition material 86 inside the vacuum chamber 71.

Reference numeral 6 in FIG. 3 represents a front panel arranged inside the film deposition chamber 22 and a heater 76 is provided at a rear surface of the front panel 6. This heater 76 is energized to heat to front panel, and vapor 88 of the vapor deposition material 86 is caused to be emitted from the evaporation source 73, a protective film of MgO such as numeral 147 shown in FIG. 8 is further grown on the transparent dielectric layer 146 of the surface of the front panel 6. After the protective film is deposited to a specified film thickness, film deposition processing is completed, the inside of the alignment chamber 11 is connected to the inside of the film deposition chamber 22, and the front panel is carried in to the alignment chamber 11. Reference numeral 6 in FIG. 1 represents a front panel that has been carried into the alignment chamber 11.

Here, an MgO film has been deposited using a Vapor deposition method, but the present invention is not limited to this, and it is possible to deposit the film using a sputtering method, an ion plating method or a CVD method.

Concurrently with the manufacture of the front panel 6 as described above, degassing of a rear panel is also carried out in the rear panel side production line 30.

Processing for the rear panel will now be described. First of all, the rear panel is carried into the degassing chamber 32 through the carry-in chamber 31. The inside of the degassing chamber 32 is constructed so that it is possible to heat a plurality of rear panels, and a plurality of rear panels are sequentially heated, subjected to degassing, and the rear panels that have completed degassing are carried in to the alignment chamber 11.

The inside of the degassing chamber is evacuated to a specified pressure, and the rear panel is carried into the alignment chamber. The inside of the alignment chamber 11 is at a vacuum atmosphere, which means that when the rear panel after degassing processing is carried in to the alignment chamber 11 from the degassing chamber 32 the rear panel is not exposed to the atmosphere, and there is no infiltration of emitted gas or atmospheric gas into the alignment chamber 11 from the rear panel.

Here, an example has been described where degassing is carried out by heating, but it is also possible to use heating and bombardment with plasma.

Figure 4:
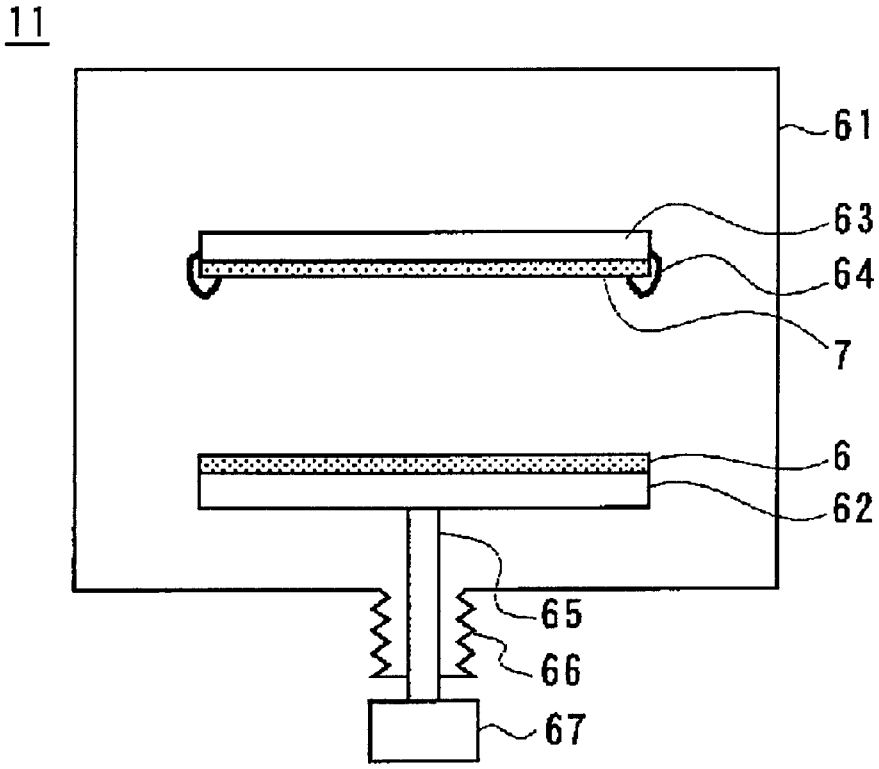
FIG. 4 is an overall schematic diagram of an alignment chamber capable of being used with the present invention.

Reference numeral 7 in FIG. 1 represents a rear panel carried into the alignment chamber 11. As shown in FIG. 4, this alignment chamber 11 has a vacuum chamber 61, and a mounting platform 62 for the front panel 6 is provided on a bottom wall of the vacuum chamber 61. A shaft 65 is provided on the bottom surface of the mounting platform 62 and a lower end of the shaft is lead out to the outside of the vacuum chamber 61 through a bellows 66 and is connected to a motor 67.

A retaining platform 63 for the rear panel is arranged towards the ceiling of the vacuum chamber 61, and a panel retaining structure 64 is provided on the retaining platform 63.

The front panel 6 that has been carried into the alignment chamber 11 is mounted on the mounting platform 62 with the MgO protective film facing upwards. Also, the rear panel 7 that has been carried into the alignment chamber 11 is held on the retaining platform 63 with a film deposition-surface facing downwards, using the panel retaining structure 64.

In this state, with the front panel 6 and the rear panel 7 parallel with each other, the shaft 65 is driven by action of the motor 67 and the front panel 6 and the rear panel 7 are, caused to rotate relative to each other, aligned so as to have a specified positional relationship, and temporarily held with a clip etc. so that there is no positional slippage.

An aging chamber 41, an examination chamber 42, a sealing chamber 43 and a carrying out chamber 44 are provided in that order in the assembly line 40 after the alignment chamber 11, from the alignment chamber 11 side. The front panel 6 and the rear panel 7 that have been subjected to relative alignment inside the alignment chamber 11 are carried into the aging chamber 41. Discharge electrode, not shown in the drawings, are provided in the aging chamber 41, and inert gas is introduced during evacuation. A voltage is applied to the front panel 6 and the rear panel 7 that have been carried in the aging chamber, electric discharge is caused between the front panel 6 and the rear panel 7, and this electric discharge causes gas that is adsorbed on the surface of the front panel 6 and the surface of the rear panel 7 is caused to be released. This process is called aging, and the front panel 6 and the rear panel 7, after completion of an aging processing, are carried into the examination chamber 42.

It is also possible to perform aging processing by placing a heating device beside the aging chamber 41, heating the front panel 6 and the rear panel 7 before aging processing to 200–500°C., and causing degassing of gas adsorbed on the surface of the front panel 6 and the surface of the rear panel 7.

It is also possible to carry out aging processing by heating without aging by electric discharge.

Figure 5:
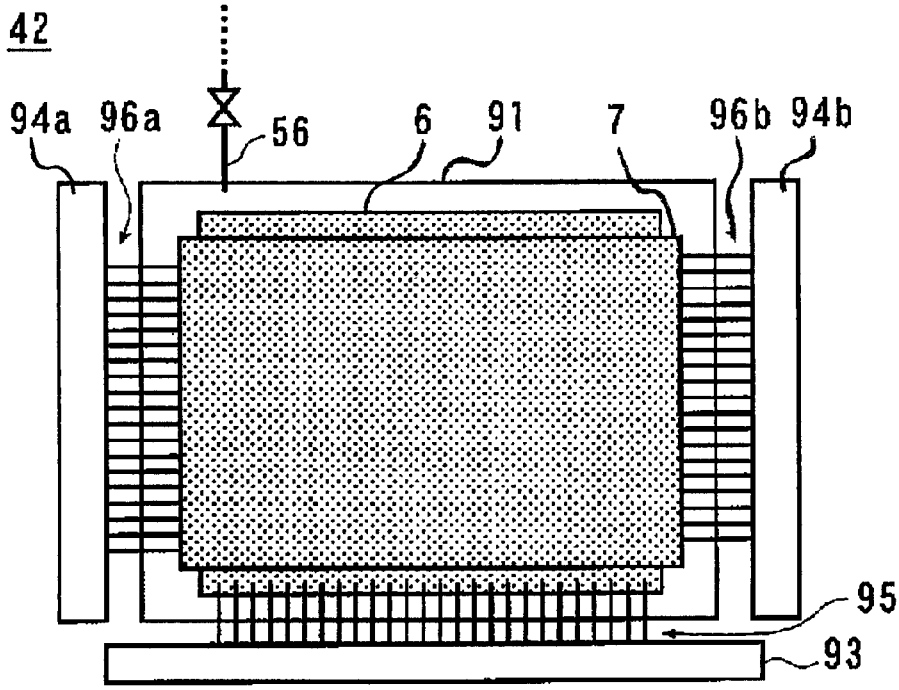
FIG. 5 is a drawing illustrating an examination chamber.

An example of the examination chamber 42 is shown in FIG. 5. The examination chamber 42 comprises a vacuum chamber 91, power supplies 93, 94*a* and 94*b*, and examination electrodes 95, 96*a* and 96*b*. The examination electrodes 95, 96*a* and 96*b* are arranged having one end inside the vacuum chamber 91 and the other end leading to the outside of the vacuum chamber 91 in an airtight manner.

The power supplies 93, 94*a* and 94*b* are arranged outside the vacuum chamber 91, and the sections of each of the examination electrodes 95, 96*a* and 96*b* outside the vacuum chamber 91 are respectively connected to the power supplies 93, 94*a* and 94*b*.

Tips of the examination electrodes 95, 96*a* and 96*b* are brought into contact with electrodes respectively formed on the surface of the front panel 6 and the rear panel 7 that have been carried on to the examination chamber 42 and have exposed surfaces, and after an inert gas such as argon, neon or xenon as been introduced into the vacuum chamber 91 to a specified pressure. The power supplies 93, 94*a* and 94*b* are activated and a voltage is applied to the front panel 6 and the rear panel 7. By doing this, plasma is generated between the front panel 6 and the rear panel 7, and when there is a non-defective article there is no fault and light is emitted. Reference numeral 56 in FIG. 1 and FIG. 5 represents a gas introduction system provided in the examination chamber 42, and inert gas is introduced from this gas introduction system 56.

This light emitting state is examined and when there is a non-defective article it is carried into the sealing chamber 43 where sealing processing is carried out. In the case of a defective article, processing in the sealing chamber 43 is not carried out and the article is ejected into the atmosphere and discarded unless it is a panel that can be renewed or used.

A front panel 6 and rear panel 7 that are non-defective articles are carried into the sealing chamber 43 and sealing processing is carried out. This sealing processing is hermetic sealing in the state where inert gas for electric discharge is enclosed between the front panel 6 and the rear panel 7, and will now be described. A seal layer is provided in advance at peripheral sections of the surface of the rear panel 7, the seal layer is caused to adhere to the front panel 6 and the seal layer arranged on the rear panel are heated while evacuating the sealing chamber 43. The seal layer is melted by beating and temporarily sealing the front panel 6 and the rear panel 7.

In this state, some through holes exist through connected sections of the front panel 6 and the rear panel 7, and gas remaining between the panels 6 and 7 is exhausted along with evacuation of the sealing chamber 43.

After temporary sealing, with the atmosphere inside the sealing chamber 43 being restored to a specified pressure gas for electric discharge, gas such as neon, or xenon, is introduced into the sealing chamber 43 up to a specified pressure, causing the discharge gas to be filled between the set of panels 6 and 7. Then, in the filled state, the through holes are blocked off and the set of panels 6 and 7 are sealed (hermetically sealed) against the atmosphere to obtain a plasma display panel. Reference numeral 57 in FIG. 1 represents a gas introduction system provided in the sealing chamber 43. Electric discharge gas is introduced into the sealing chamber 43 from the gas introduction system 57.

Finally, the manufactured plasma display panel is carried into the carrying out chamber 44, and after disconnecting between the sealing chamber 43 and the carrying out chamber 44 the atmosphere is introduced into the carrying out chamber 44 making it possible to take out the plasma display device.

As has been described above, after the front panel 6 and the rear panel 7 have been respectively carried in to the carry-in chamber 21 and.the carry-in chamber 31, they are consistently processed in a vacuum atmosphere until being taken out from the carrying out chamber 44, which means that the MgO protective film deposited on the surface of the front panel 6 is not exposed to the atmosphere and so there is no degradation of the protective film.

Also, the front panel 6 and the rear panel 7 are degassed, and after being aligned, are subjected to aging without being exposed to the atmosphere, which means that the amount of adsorbed gas that will be caused to be released is reduced by the aging process and the aging time can be shortened.

Measurements of break-down voltage $V_f$ and discharge sustaining voltage $V_s$ were taken with respect to the aging time for the plasma display device produced using the method of the present invention.

Evaporation conditions for the MgO film are shown in Table 1.

TABLE 1

| Evaporation Conditions | |
|---|---|
| Evaporation Material | MgO |
| Pressure Attained | $5.6 \times 10^{-8}$ torr |
| Distance Between Evaporation Source & Panel | 500 Mm |
| Method Of Heating Evaporation Source | Electron Beam Heating |
| Pressure During Vapor Deposition (Introduction Of $O_2$) | $1.7 \times 10^{-4}$ torr |
| Substrate Temperature | 160° C. |
| Vapor Deposition Time | 6 Minutes 46 Seconds |
| Substrate Film Thickness | 7000 Å |
| Vapor Deposition Rate | 17.2 Å/sec |

Electrode structure and discharge voltage measurement conditions for this plasma display devixce are shown in table 2 and table 3.

TABLE 2

| Electrode structure | |
|---|---|
| Low Melting Point lead Glass | 45 ± 5 μm |
| ITO Discharge Gap | 50 ± 2 μm |

TABLE 3

| Electric Discharge voltage measurement conditions. | |
|---|---|
| Gas | Ne-4%Xe |
| Electric Discharge Pressure | 200 torr |
| Electric Discharge frequency | 10 kHz |

As a comparative example, after a front panel having an MgO film deposited under the evaporation conditions of table 1 was exposed to the atmosphere (humidity 54%) for 30 minutes, heat degassing was carried out at 350°C. in a vacuum atmosphere for 3 hours and break-down voltage $V_f$ and discharge sustaining voltage $V_S$ were measured. The electrode structure and measuring conditions were as shown in table 2 and table 3 above. With the front panel of this comparative example, the pressure at the time of starting thermal degassing was $8\times10^{-5}$ torr, and at completion, the pressure was $6.2\times10^{-6}$ torr.

Figure 6:
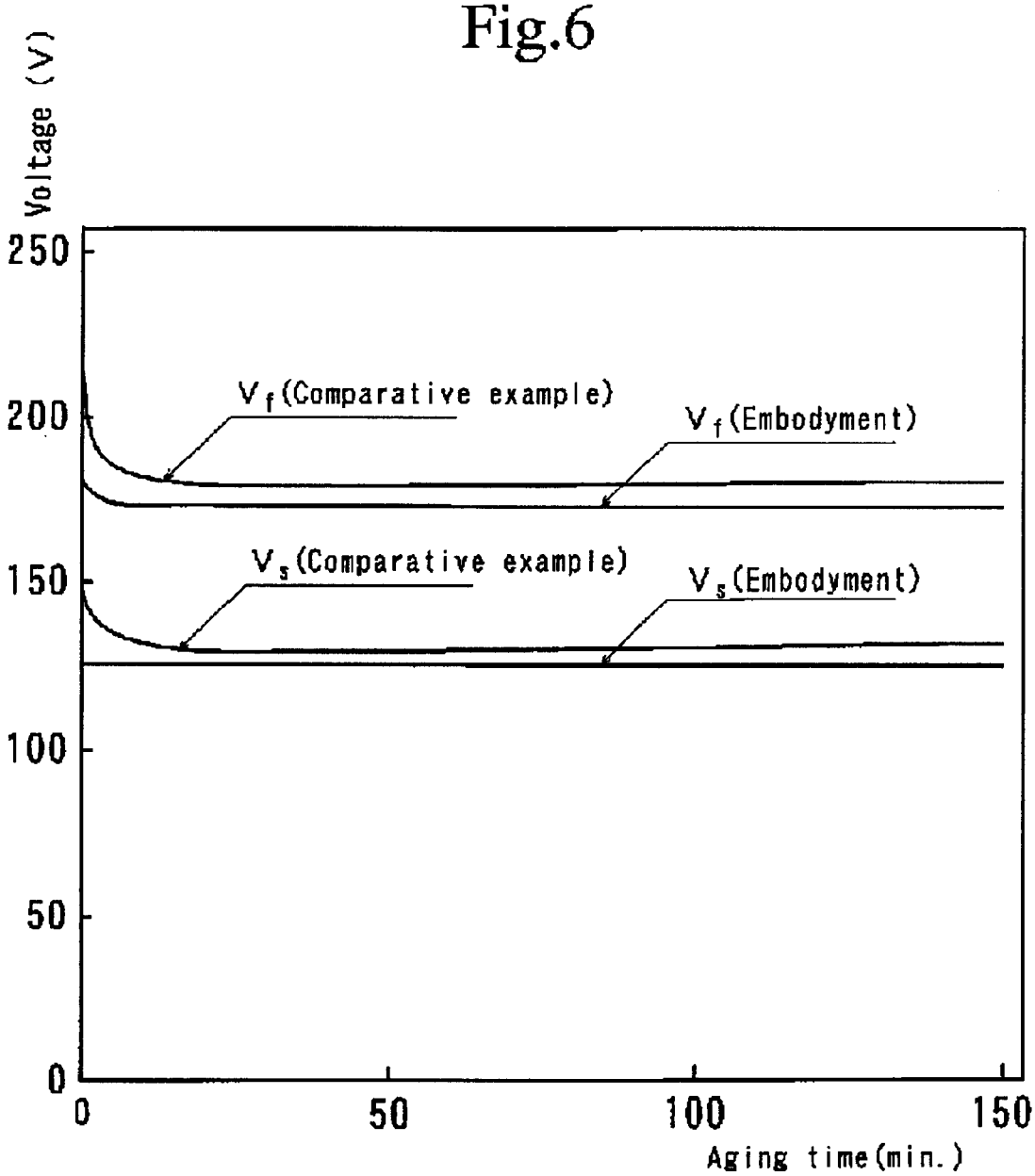
FIG. 6 is a graph showing the relationship between aging time and a break-down voltage and a discharge sustaining voltage.
Figure 7:
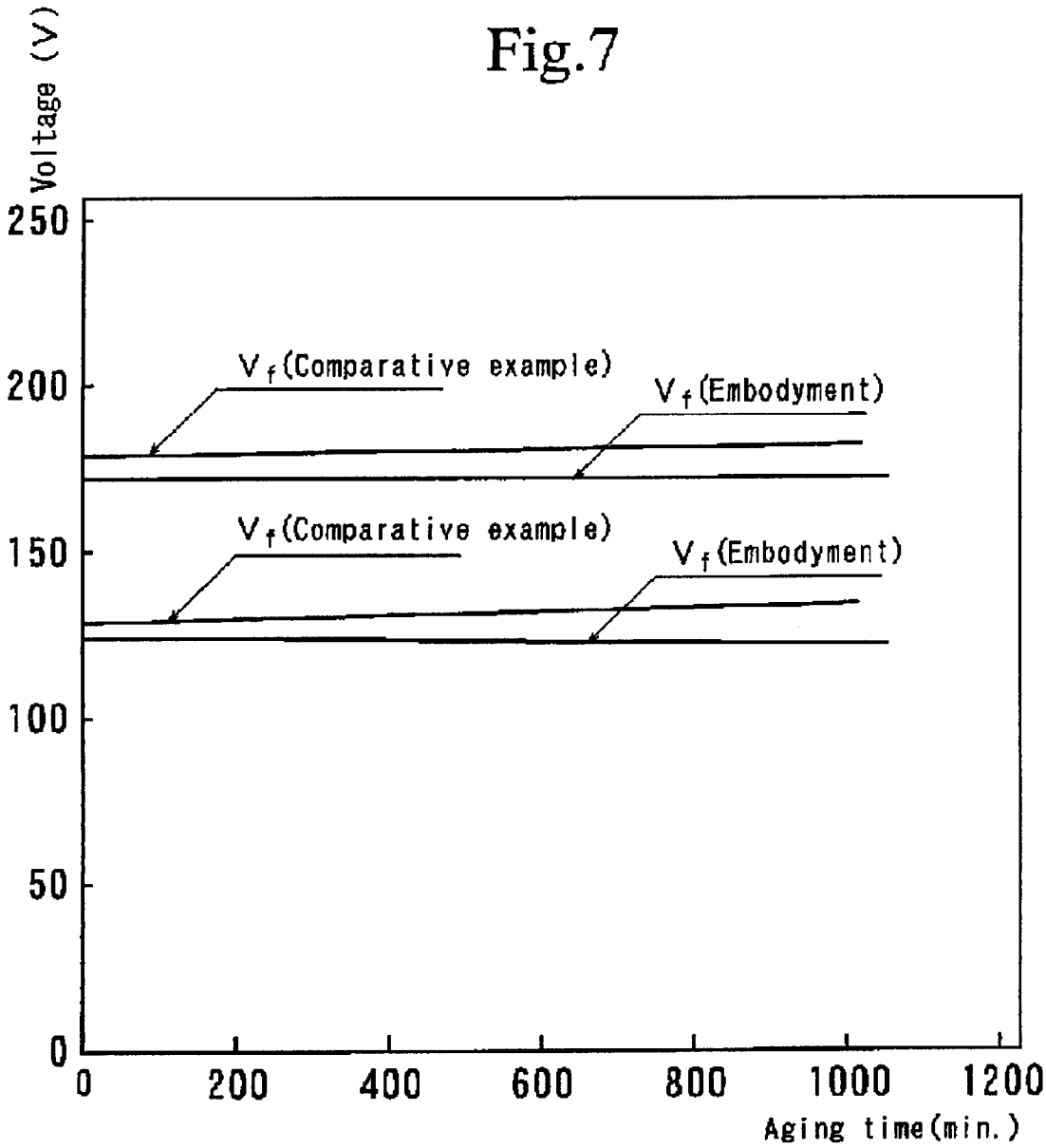
FIG. 7 is a graph showing the relationship between aging time and a break-down voltage and a discharge sustaining voltage.

Measurement results are shown in FIG. 6 and FIG. 7. When the comparative example was exposed to the atmosphere, the break-down voltage $V_f$ and the discharge sustaining voltage $V_s$ increased together, and it will be understood that the embodiment of the present invention is much improved. Also, the time until the voltage became constant was about 2 minutes in the case of the embodiments compared to the 10 minutes which was required in the comparative example, and it will be understood that the embodiment of the present invention is faster.

In the above described aging chamber 41, when degassing is caused by heating the front panel 6 and the rear panel 7, if plasma bombardment is used at the same time the set of panels 6 and 7 can be degassed by only raising from the room temperature to about 100° C., which means that there is no need for any cooling down time and the throughput can be significantly improved.

Another embodiment of the present invention will now be described.

Figure 2:
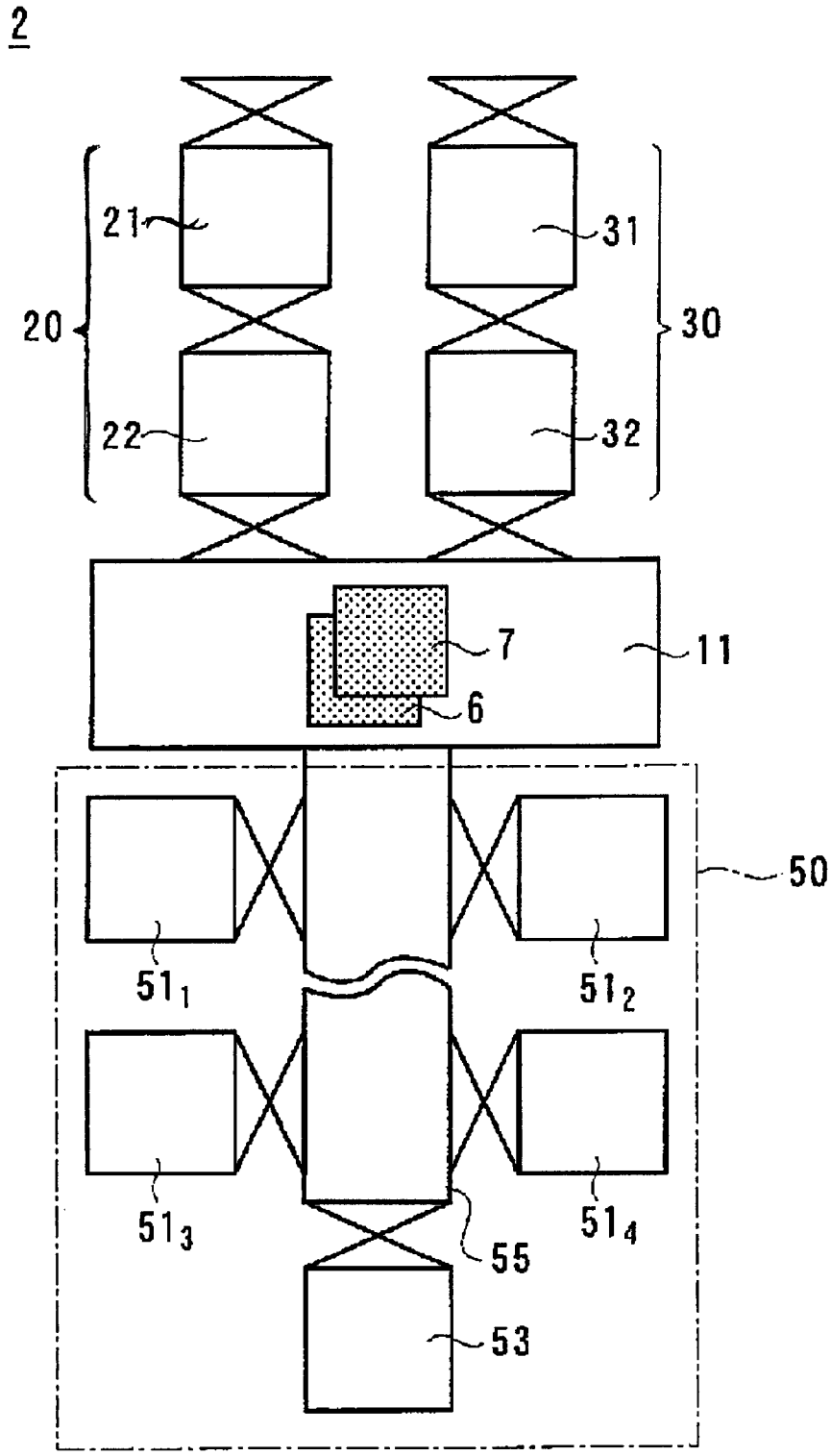
FIG. 2 shows a second example of a vacuum device of the present invention.

Referring to FIG. 2, reference numeral 2 represents a second embodiment of a vacuum device, and has a similar structure to the vacuum device of the first example, and a similar arrangement of a front panel side production line 20, a rear panel side production line 30 and an alignment chamber 11.

On the other hand, the vacuum device 2 has an assembly line 50 different from the structure of the vacuum device 1.

The assembly line 50 has a conveyance path 55, and one end of the conveyance path 55 is connected to the alignment chamber 11.

The inside of the conveyance path 55 is in a vacuum atmosphere, and while sustaining the vacuum atmosphere inside the alignment chamber 11 the front panel 6 and rear panel 7 that have been aligned inside the alignment chamber 11 are carried into the conveyance path 55 in a temporarily fixed state.

A carrying out chamber 53 is provided at an end of the conveyance path 55 opposite the alignment chamber 11, and a plurality of processing chambers $\mathbf{51}_1$–$\mathbf{51}_4$ are provided along the conveyance path 55 between the alignment chamber 11 and the carrying out chamber 53. A heating device and a gas introduction system are provided in each of the processing chambers $51_1$–$51_4$ (though not shown in the drawings), and each processing chamber $51_1$–$51_4$ has the same structure.

When processing is carried out after alignment, the front panel 6 and the rear panel 7 that have been aligned in the alignment chamber 11 are carried in to the empty processing, chamber $51_1$. Inside this processing chamber $51_1$, aging is carried out during evacuation, an electric discharge gas is introduced and the panels are examined light emission examination without moving.

Next, the introduction of electric discharge gas is stopped, and the front panel 6 and the rear panel 7 are sealed inside the processing chamber $51_1$ while evacuating the chamber.

After fusion, the atmosphere inside the processing chamber $51_1$ is restored to a specified pressure and if electric discharge gas is again introduced into the processing chamber $51_1$, hermetic sealing is carried out with this electric discharge gas filled between the panels 6 and 7 to obtain a plasma display device.

While processing is being carried out inside the processing chamber $51_1$, the front panel 6 and the rear panel 7 that have been subjected to alignment in the alignment chamber 11 are carried into the other processing chambers $51_2$–$51_4$, where each of the processes of aging, examination, and sealing (gas encapsulation or hermetic sealing) are carried out.

When processing in the processing chambers $51_2$–$51_4$ is completed, the manufactured plasma display panel is carried in to the carrying out chamber 53 via the conveyance path 55, and the carrying out chamber 53 and the conveyance path 55 are disconnected. After that, the atmosphere is introduced into the carrying out chamber 53 and the plasma display panel is taken out.

In this way, the second embodiment aging process that requires a long time is carried out concurrently in the processing chambers $51_2$–$51_4$, and it is possible to carry out processing for a plurality of front panels 6 and rear panels 7 consecutively.

As described above, by using the vacuum device of the present invention, there is no degradation of a protective film (MgO), and the aging process is rapid, which means that it is possible to manufacture a high quality plasma display panel at low cost.

With the vacuum device of the first and second embodiments of this invention, gas encapsulation is carried out after optical examination, but it is also possible to carry out optical examination after gas encapsulation. It is also possible to carry out aging processing and optical examination inside the alignment chamber.

The present invention makes it possible to deposit a high quality MgO file, and enables increased throughput in the manufacture of plasma display devices.

What is claimed is:

1. A vacuum device for manufacturing a plasma display device having a front panel and a rear panel, comprising:

a film deposition chamber for depositing a thin film on a surface of the front panel in a vacuum atmosphere; and an alignment chamber for relatively aligning the front panel and the rear panel in the vacuum atmosphere, wherein the front panel is conveyed between the film deposition chamber and the alignment chamber without being exposed to the atmosphere.

2. The vacuum device of claim 1, wherein the rear panel is conveyed into the alignment chamber without passing through the film deposition chamber.

3. The vacuum device of claim 2, wherein when the rear panel is conveyed, the alignment chamber maintains a vacuum atmosphere.

4. The vacuum device of claim 3, wherein an assembly line having a hermetic sealing chamber is connected to the alignment chamber, the relatively aligned front panel and rear panel are conveyed from the alignment chamber into the hermetic sealing chamber without being exposed to the atmosphere, and gas is introduced between the relatively aligned front panel and rear panel, to enable sealing.

5. The vacuum device of claim 4, wherein an aging chamber having a heating device located therein is provided in the assembly line, the relatively aligned front panel and rear panel are conveyed into the aging chamber before being sealed, the heating device is caused to generate heat while the inside of the aging chamber is being evacuated, and the front panel and the rear panel are heated in the state of being relatively aligned.

6. The vacuum device of claim 4, wherein an aging chamber having a power supply is provided in the assembly line, the relatively aligned front panel and rear panel are conveyed into the aging chamber before being sealed, electric discharge gas is introduced into the aging chamber while it is being evacuated, a voltage is applied to electrodes on the front panel and the rear panel by the power supply, and electric discharge is caused between the front panel and the rear panel.

7. The vacuum device of claim 4, wherein an examination chamber having a power supply is provided between the aging chamber and the sealing chamber, the front panel and the rear panel having completed processing in the aging chamber are conveyed to the examination chamber before sealing, a voltage is applied by the power supply to electrode on the front panel and the rear panel while evacuating the examination chamber, and electric discharge is caused between the front panel and the rear panel.

8. The vacuum device of claim 2, wherein an assembly line having a hermetic sealing chamber is connected to the alignment chamber, the relatively aligned front panel and rear panel are conveyed from the alignment chamber into the hermetic sealing chamber without being exposed to the atmosphere, and gas is introduced between the relatively aligned front panel and rear panel, to enable sealing.

9. The vacuum device of claim 8, wherein an aging chamber having a heating device located therein is provided in the assembly line, the relatively aligned front panel and rear panel are conveyed into the aging chamber before being sealed, the heating device is caused to generate heat while the inside of the aging chamber is being evacuated, and the front panel and the rear panel are heated in a relatively aligned state.

10. The vacuum device of claim 8, wherein an aging chamber having a power supply is provided in the assembly line, the relatively aligned front panel and rear panel are conveyed into the aging chamber before being sealed, electric discharge gas is introduced into the aging chamber during evacuation of the aging chamber, a voltage is applied to electrodes on the front panel and the rear panel by the power supply, and electric discharge is caused between the front panel and the rear panel.

11. The vacuum device of claim 8, wherein an examination chamber having a power supply is provided between the aging chamber and the sealing chamber, the front panel and the rear panel having completed processing in the aging chamber are conveyed to the examination chamber before sealing, a voltage is applied by the power supply to electrode on the front panel and the rear panel while evacuating the examination chamber, and electric discharge is caused between the front panel and the rear panel.

12. A method of manufacturing a plasma display device comprising the steps of:

conveying a front panel into a film deposition chamber, depositing a thin film in a vacuum atmosphere and then conveying the front panel to an alignment chamber without exposing to the atmosphere;

relatively aligning the front panel and separately conveying the rear panel inside the alignment chamber; and sealing the front panel and the rear panel with an electric discharge gas introduced between the front panel and the rear panel.

* * * * *